US006470910B2

(12) United States Patent
Blackbourn et al.

(10) Patent No.: US 6,470,910 B2
(45) Date of Patent: Oct. 29, 2002

(54) TAP WITH INCORPORATED AIR PASSAGEWAY

(75) Inventors: Geoffrey Blackbourn, Cambridge (GB); Ian Woodward, Surrey (GB)

(73) Assignee: Waddington and Duval Limited, London (GB)

( * ) Notice: Subject to any disclaimer, the term of this patent is extended or adjusted under 35 U.S.C. 154(b) by 0 days.

(21) Appl. No.: 10/083,929

(22) Filed: Feb. 27, 2002

(65) Prior Publication Data

US 2002/0079001 A1 Jun. 27, 2002

Related U.S. Application Data

(63) Continuation of application No. 09/600,090, filed as application No. PCT/GB99/00136 on Jan. 15, 1999, now Pat. No. 6,401,752.

(30) Foreign Application Priority Data

Jan. 16, 1998 (GB) ..... 9801006

(51) Int. Cl.[7] ..... B67D 3/04

(52) U.S. Cl. ..... 137/588; 137/589; 222/484; 222/518

(58) Field of Search ..... 137/588, 589; 222/488, 518, 484

(56) References Cited

U.S. PATENT DOCUMENTS

| | | | | |
|---|---|---|---|---|
| 629,327 | A | 7/1899 | Barger | 137/588 |
| 720,854 | A | 2/1903 | Spiegler | 222/488 |
| 1,066,178 | A | 7/1913 | Bonnell | 137/588 |
| 2,197,352 | A | 4/1940 | Terkel | 137/588 X |
| 2,248,958 | A | 7/1941 | Christensen et al. | 222/488 X |
| 3,187,770 | A | 6/1965 | Plamann | 138/589 |
| 3,376,582 | A | 4/1968 | Samuels | 222/488 |
| 3,612,100 | A | 10/1971 | Kapeker | 137/589 X |
| 4,440,316 | A | 4/1984 | Christine | 222/518 X |
| 4,452,425 | A | 6/1984 | Lucking | 222/518 X |
| 4,664,297 | A | 5/1987 | Giovanazzi | 222/185 |
| 4,693,400 | A | 9/1987 | Frahm et al. | 222/518 |
| 4,930,689 | A | 6/1990 | Stumpf | 222/518 X |

FOREIGN PATENT DOCUMENTS

| | | |
|---|---|---|
| DE | 8809596 | 9/1988 |
| EP | 0112938 | 7/1984 |
| FR | 2608722 | 6/1988 |
| GB | 2169061 | 7/1986 |

*Primary Examiner*—John Rivell
(74) *Attorney, Agent, or Firm*—Wood, Herron & Evans, L.L.P.

(57) ABSTRACT

A tap comprising a body having a liquid flow passageway between a liquid inlet and a liquid outlet and an air flow passageway between an air inlet and an air outlet. A valve system including a valve seat is provided for controlling liquid and air flow in the passageways which is operated by a push button. When the air inlet and liquid outlet are coincident, the valve seat may be at or adjacent the liquid outlet. When the air outlet and liquid inlet are coincident, the valve seat may be at the liquid inlet.

9 Claims, 4 Drawing Sheets

TAP WITH INCORPORATED AIR PASSAGEWAY

RELATED APPLICATIONS

The present application is a continuation of application Ser. No. 09/600,090 filed Sep. 15, 2000, now U.S. Pat. No. 6,401,752, which claims the priority of PCT Ser. No. PCT/GB99/00136 filed on Jan. 15, 1999, published on Jul. 22, 1999, which claims the priority of German patent application No. 9801006.9, filed on Jan. 16, 1998. The disclosures of each of these prior related applications are hereby fully incorporated by reference herein.

BACKGROUND OF THE INVENTION

It is known to provide molded plastic taps for use with containers, in particular disposable containers of the type popular for supplying liquid such as water, wine or milk. One well known type of tap for this purpose is a so-called push button tap having a resilient plastic diaphragm which, when pressed, opens the valve to allow liquid to flow from the container. The resilient plastic diaphragm, commonly referred to as a "push button", can be arranged so that it positively urges the valve into a sealing position when manual pressure is removed therefrom. The tap is therefore self-closing.

An alternative to push button taps are the so-called "rotary" taps. In these, a cap is rotated to in turn rotate a stem within the tap body. Rotation of the stem causes it to uncover an aperture provided in the tap body through which or from which liquid is dispensed. The problem with rotary taps is that effective sealing of these is generally more difficult to achieve than with push button taps. Furthermore rotary taps are not self closing.

Irrespective of the type of tap used, it is found with containers that smooth liquid flow with a stabilized flow profile can only be achieved if either the container is flexible and collapses as liquid is dispensed or the container is vented. The reason for this is that otherwise air must flows into the container to fill the space from which liquid has been vacated and equalize the pressure within the container. The inflow of air disrupts the outflow of liquid causing it to be uneven and reducing the flow rate.

It is an object of the present invention to provide a self closing tap which will give smooth liquid flow even with rigid closed containers. It is a further object to provide a tap which will maximize the flow rate and in addition give constant flow even when the container is near empty.

SUMMARY OF THE INVENTION

A tap in accordance with the invention comprises a body having a liquid flow passageway between a liquid inlet and a liquid outlet, an air flow passageway between the air inlet and an air outlet, a valve system for controlling liquid and air flow in the passageways, and, a push button for operating the valve system.

The advantage of this is that by providing an airflow passageway which is at least in part separately formed from the liquid flow passageway, air can flow into the container simultaneously with dispensing of liquid therefrom. Thus the pressure can continuously be equalized between the interior of the container and the exterior, ambient environment, and the liquid will flow smoothly and at the maximum possible flow rate, dictated by the size of the outlet, without requiring venting of a container with which the tap is used or collapse thereof.

The air inlet and liquid outlet are generally coincident or adjacent each other. The air outlet may be adjacent the liquid inlet or it may be spaced therefrom, in particular the air inlet may be provided such that, in use with the tap fixed to a container, it is located within the container.

The valve system is preferably of the type comprising a valve seat, a valve element and a valve stem connecting the valve element to the push button.

In one embodiment the air and liquid flow passageways are both downstream of the valve seat, whilst in a second embodiment they are both upstream of the valve seat. In the first, the valve seat is provided at the liquid inlet of the tap, whilst in the second, the valve seat is provided at the liquid outlet. The second permits of an airflow passageway which extends beyond the liquid inlet and, in use, into the container with which the tap is employed. The first embodiment does not allow such an elongate airflow passageway and it was unexpected that the air flow is still sufficient to establish smooth liquid flow.

The valve stem preferably moves in guide means which define in part the liquid flow passageway and/or the air flow passageway. The guide means therefore serve a dual purpose of assisting in tap closure through guidance of the valve stem and also defining one or both of the passageways. The guide means, in a form which is particularly suitable for the first embodiment discussed above, comprises first and second spaced guide sleeves. The advantage of this, as will be discussed further below, is that a greater portion of the valve stem is wiped during passage through the guide means and liquid thereon additionally has to traverse the air gap created by the spacing between the sleeves which reduces the chances of it entering the push button.

Very preferably in the first embodiment the tap also comprises a flexible member fixed between the valve stem and the tap body which prevents liquid access to the push button. The flexible member serves the purpose of preventing pockets of liquid being caught in the push button which can go sour and adversely affect the quality of subsequently dispensed liquid.

The tap is preferably provided with a spout which in use can be arranged vertically or generally vertically. In the first embodiment the valve stem will move generally horizontally, i.e. transversely, or generally transversely, to the spout. whilst in the second embodiment the valve stem will move vertically, i.e. parallel to the axis of the spout. With the first embodiment, the spout may include a dividing wall defining the liquid outlet and the air inlet as well as, in part, the air flow passageway and the liquid flow passageway, but in the second this is not possible since it would prevent movement of the valve element within the spout to open and close the tap.

The first embodiment which may be called a front push tap in that generally manual pressure will be provided to the "front" of the container to move the valve stem horizontally, has the advantage that only a very small amount of the tap is between the container contents and the external environment. Thus the air penetration through the tap is minimized, as too is the decay of liquid carried within a container fitted with the tap. Another advantage of this embodiment is that the pressure of the liquid remaining in the container tends to close the valve element against the valve seat when manual pressure is removed from the push button.

A significant advantage of the second embodiment, which may be termed a top push version as generally manual pressure will be applied from above to move the valve stem vertically, is that no liquid will be trapped between the valve element and the liquid outlet as the valve element is at the outlet which means that there is no chance of dripping nor of any retained liquid going sour and then spoiling subsequently dispensed liquid.

BRIEF DESCRIPTION OF THE DRAWINGS

The invention will now be further described by way of example with reference to the accompanying drawings in which.

DETAILED DESCRIPTION OF THE PREFERRED EMBODIMENTS

Figure 1:
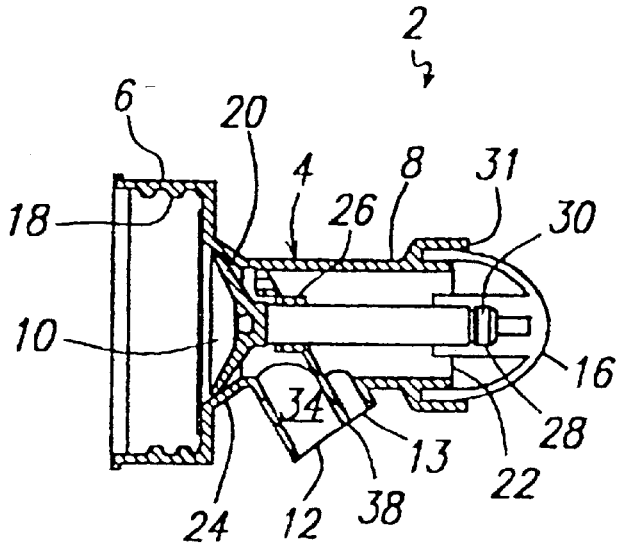
FIG. 1 is a side view partially sectional of first embodiment of a tap in accordance with the invention in the closed, non-liquid dispensing, position.
Figure 3:
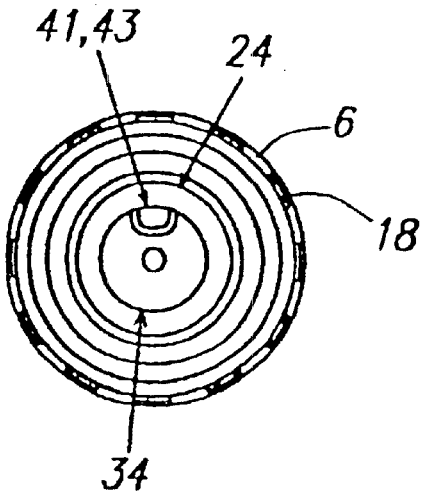
FIG. 3 is an end view taken in the direction of arrow III of FIG. 1 but with the valve element omitted.
Figure 2:
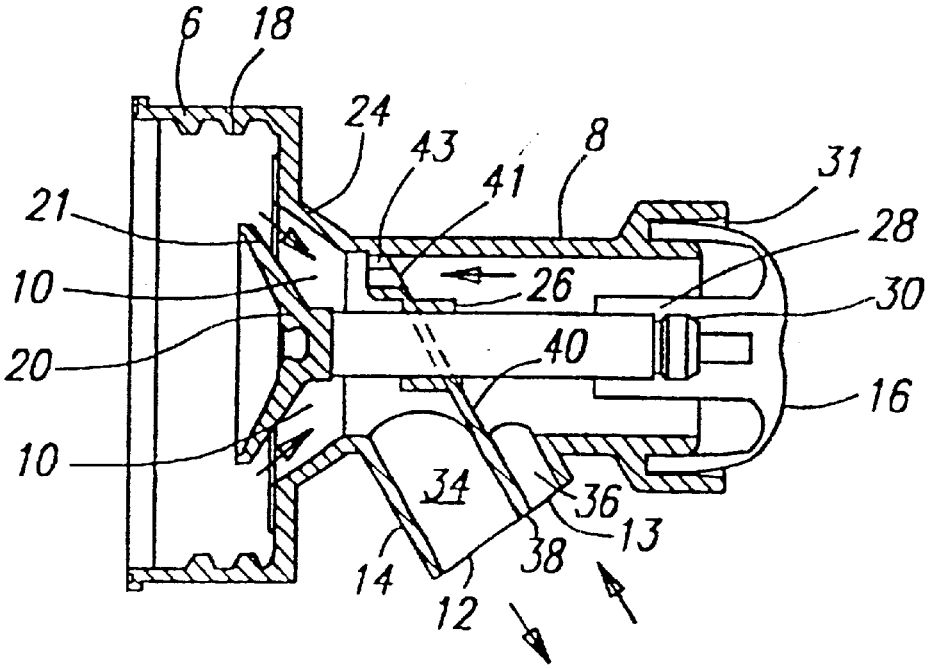
FIG. 2 is a view similar to FIG. 1 but enlarged and showing the tap in the open liquid dispensing position.

The tap 2 shown in FIGS. 1 to 3 comprises a body 4 having an inlet portion 6 and a body portion 8 which meet at a liquid inlet 10 which in this embodiment is also the air outlet. The body portion 8 includes a liquid outlet 12 and an air inlet 13 at the end of a spout 14. The body portion 8 extends from the inlet 10 across the outlet 12 and is closed at the other end by push button 16. The body 4 may be formed from any suitable material such as high-density polyethylene, low-density polyethylene, polypropylene or linear low-density polyethylene. The button 16 needs to be resilient but flexible so that it is capable of large deformation under manual pressure but subsequently resuming its original shape when the pressure is removed. The button 16 is suitably formed from an elastomeric polymer, for example ethylene vinyl acetate, metallocene polythene or polybutylene terephthlate.

The inlet portion 6 is formed with screw threads 18 to allow attachment of the tap 2 to a liquid container. It will be appreciated that the tap 2 can be attached to a container in other ways but a connection which is not destroyed on removal of the tap 2 after emptying of the container may be preferred because it makes the tap 2 reusable.

The tap 2 is provided with a valve system for controlling liquid and air flow therethrough. In the tap 2 of FIGS. 1 to 3 the valve system serves to provide a seal at the inlet 10 and comprises a valve element 20 carried on a valve stem 22. The valve element 20 is frustoconical and has a flared mouth and a sealing bead 21 (see FIG. 4). The inlet 10 is formed with walls 24 which have a corresponding frustoconical shape.

The valve stem 22 extends through guide means comprising a guide collar 26 and is connected to a elongate boss 28 which protrudes downwardly from the button 16, the end of the valve stem 22 being press or snap fit in a correspondingly shaped aperture 30 in the boss 28. The locking of the button 16 to the valve stem causes press fitting of the button skirt within a rim 31 formed at the end of the body portion 8 across the outlet 12 from the inlet 10 which forms a seal between the button 16 and body portion 8.

The spout 14 is divided into the two outlets 12, 13 and into two passages 34, 36 by an intermediate wall 38. The wall 38 stems from a flange 40 which extends diagonally across the body portion to divide the interior into two regions. The flange 40 includes a central aperture banded by guide collar 26 through which the valve stem 22 moves and an upper aperture 41. The aperture 41 provides the connection between the two regions into which the flange 40 divides the interior of the tap body portion 8. the flange 40 may have a part-circular boss 42 which with the adjacent wall of the body portion 8 defines a passage 43 extending from aperture 41.

In the position shown in FIG. 1, in which the button 16 is unpressed, the frustoconical valve element 20 seats in the frustoconical walls 24 of the inlet 10 and sealing bead 21 is compressed against the walls 24 so that no liquid can flow from a container with which the tap 2 is used. When pressure is applied to the button 16, the valve stem 22 and frustoconical valve element 24 move into the inlet portion 6 of the tap 2 towards the container which unseats the valve element 20 from the valve seat constituted by the frustoconical walls 24. As a result liquid can flow from the container around the valve element 20 and into the body portion 8 as shown by the arrows in FIG. 2. The liquid will flow against the flange 40 and pass down the passage 34 of the spout 14.

The outflow of liquid will cause a reduction in pressure in the container which will draw air up through the passage 36 into the second region of the interior of the body portion. The air will flow through aperture 41, passage 43 and around the valve element 20 and into the container. It was unexpected that this return air could "jump" across the valve into the main body of the container in sufficient small volume packets to establish smooth flow by filling the space created on outflow of the liquid from the tap 2. The result is stabilization of the liquid flow profile and in addition maximum flow rate. This liquid outflow does not have to cease to allow air inflow due to the provision of the two passages 34, 36.

It has been found that the volume of the air passageway formed by passages 36 and 43 and the second region of the body portion 8 can be much less than that of the liquid passageway formed by passage 34 and the first region of the body portion 8 and in particular that satisfactory results can be achieved with a liquid to air passageway volume ratio of 6:1.

In FIGS. 1 to 3, the liquid outlet 12 and air inlet 13 are shown adjacent each other but it should be noted that the air inlet 13 could be provided elsewhere, for example, in the top wall of the body portion 8, "top" being understood in the sense of the Figures. In this case wall 38 would not be required and flange 40 would be arranged to separate the second region from the spout 14 with the spout 14 then providing solely the liquid outlet 12.

One problem with known taps is the potential for contamination of liquid carried in a container to which the tap is fitted, as has already been mentioned above. Contamination can occur through oxygen transmission through the tap itself which can occur via two mechanisms: firstly permeation through the polymer molecular structure of the components of the tap, and secondly through micro channels at the interfaces of the tap components.

The tap 2 of FIGS. 1 to 3 minimizes oxygen ingress through both of these mechanisms. As to the first, the surface area of plastic which is acting as a barrier between the liquid and the container and ambient surrounding air is minimal being simply the valve element 20 and a very small region of the body adjacent the screw threads 18. In many known taps other tap components are available for oxygen transmission, in particular the button which because of its necessary flexible nature can be a large source of oxygen transfer. As to the second, the only interface between the liquid and the ambient surrounding air is between the valve element 20 and the inlet walls 24.

It is expected that typically the tap 2 of FIGS. 1 to 3 will give an improvement in oxygen transmission rate of 3, that is the oxygen transmission will be reduced by at least two thirds. The result will be significantly extended pre-dispensing shelf life which is important, particularly for containers used for wine.

Figure 4:
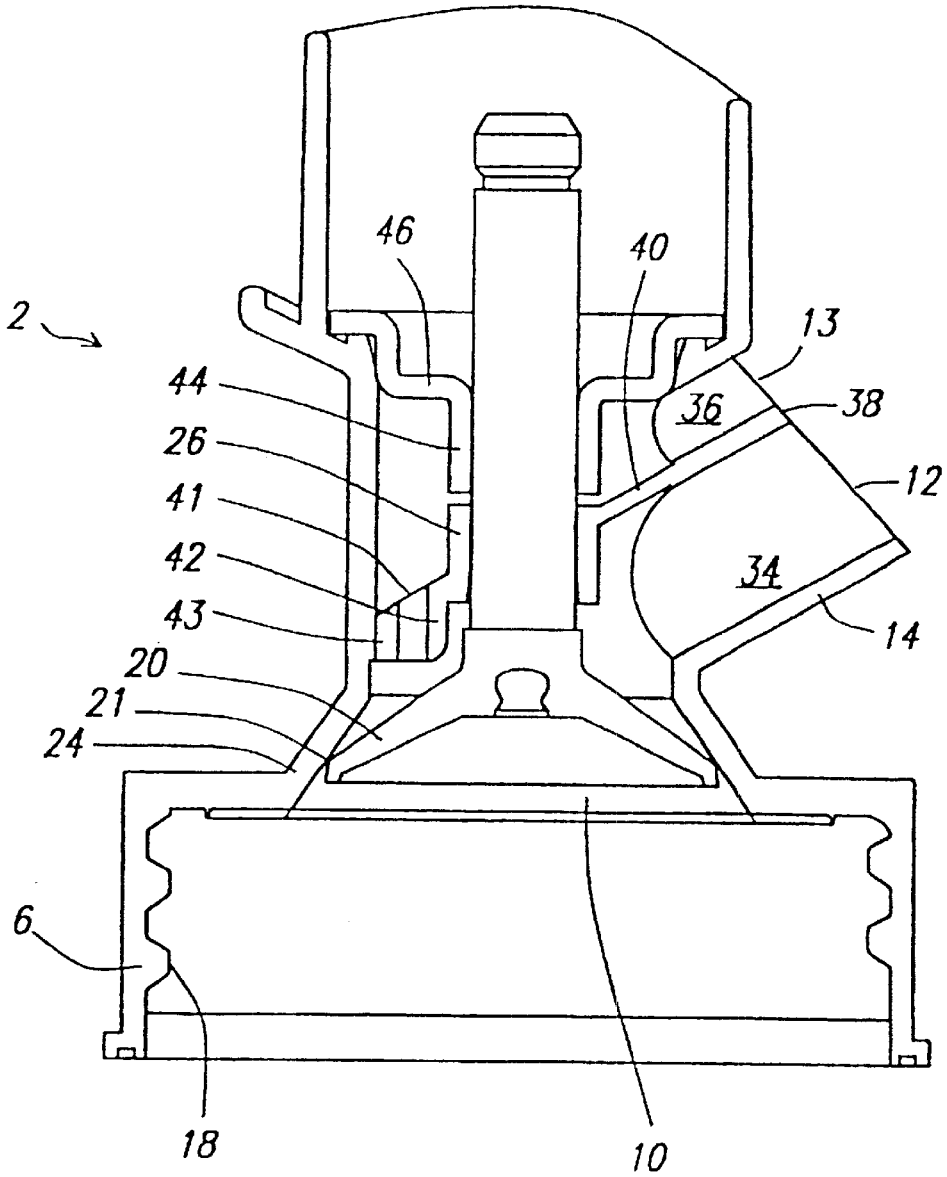
FIG. 4 is a similar view to FIG. 1 but showing an alternative guide means for the tap.

FIG. 4 shows an alternative version of the tap 2 of FIGS. 1 to 3. The majority of the parts are the same and therefore like reference numerals will be used for like parts.

The major change is that the guide means comprises a second guide sleeve 44 spaced from the first 26. In addition, the first guide sleeve 26 is comparatively longer than that of the tap 2 of FIGS. 1 to 3. Liquid on the surface of the stem 22 following dispensing has therefore to pass through two relatively long sleeves 26 and 44 which will tend to "wipe" off the liquid and allow it to drop down through liquid passage 34. In addition, the spacing between the guide sleeves 26 and 44 provides an air gap which will tend to cause liquid to fall and pass out through air passage 36. Thus the system prevents liquid on the surface of the stem 22 from being drawn back into the button 16. This is advantageous because liquid in the button could drain down the air passage 36 when the button is pressed which could upset the air return mechanism and also contaminate liquid then being dispensed from the container into a receptacle.

As shown in FIG. 4, the second guide sleeve 44 may in fact be configured as a bellows or gaiter which is tagged to both the valve stem 22 and the body portion 8 so as to move with the valve stem 22 on pressing and release of the button 16. The skirt 46 extending between the second guide sleeve 44 and the body portion 8 will provide a complete barrier to liquid entering the button 16.

The tap 2 of FIGS. 1 to 3 and 4 may be termed a "front push" tap, in that, as connected to a container, pressure is applied to the button 16 in a direction generally towards the front of the container.

Figure 5:
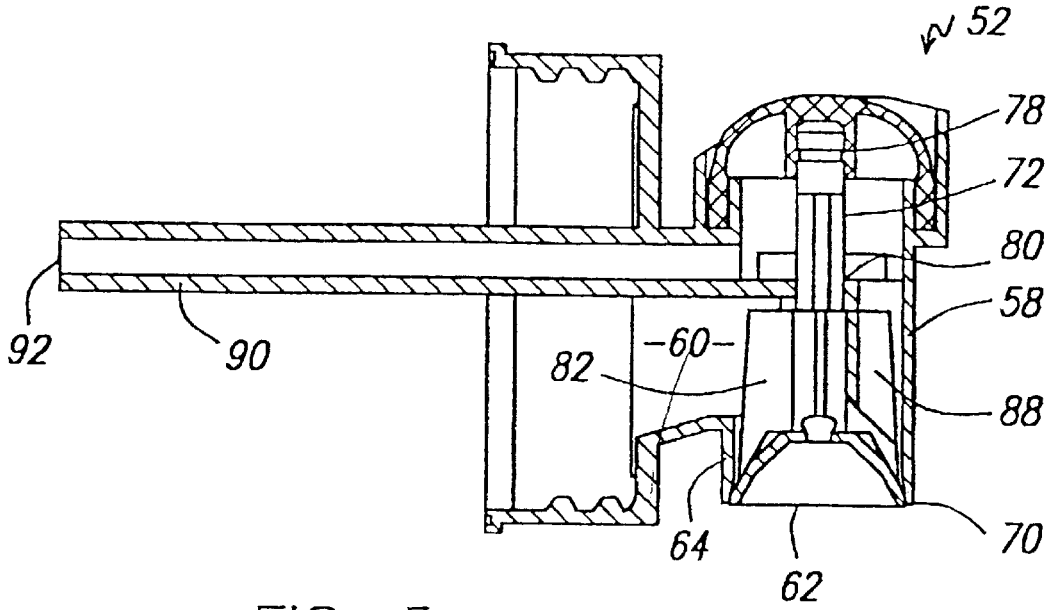
FIG. 5 is a transverse section through a second embodiment of a tap in accordance with the invention in the closed, non-liquid dispensing position.
Figure 6:
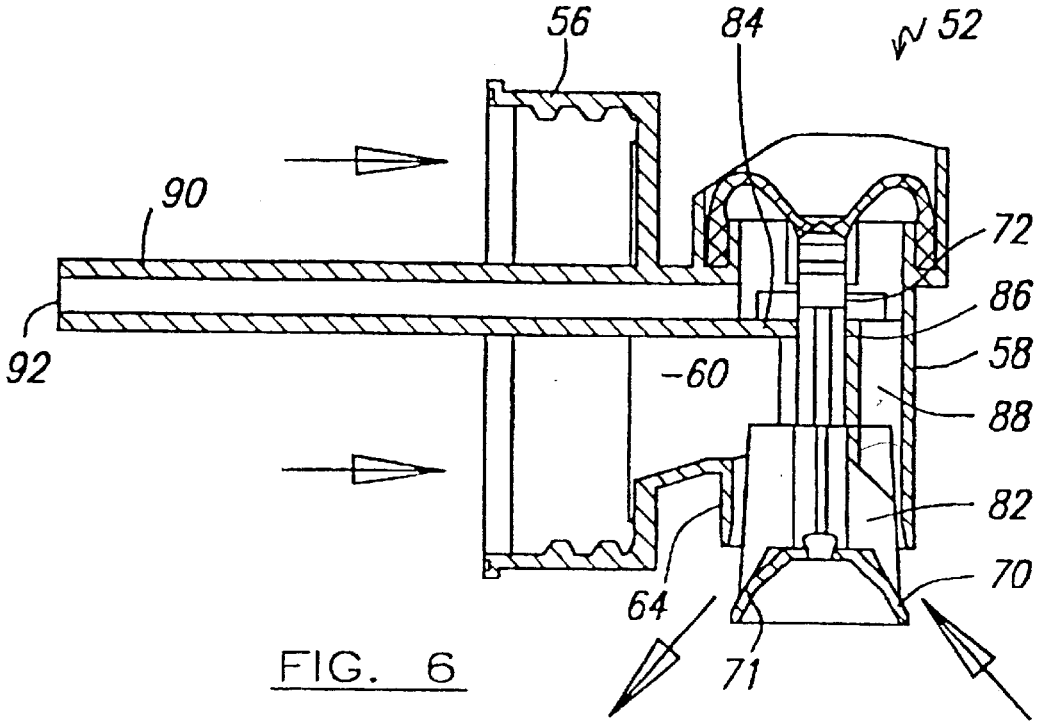
FIG. 6 is a vertical section through the tap of FIG. 5 but in the open, liquid dispensing, position.
Figure 7:
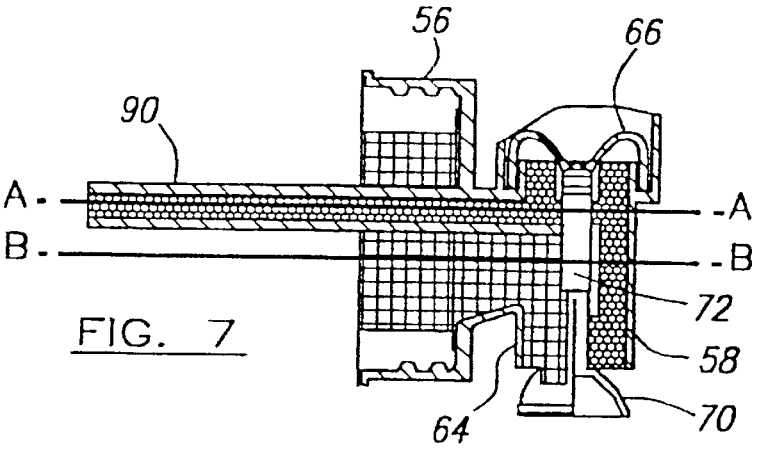
FIG. 7 is a similar view to FIG. 6 and FIGS. 7A and 7B are sections taken along lines A—A and B—B, but shaded to show liquid and air flow.

The tap of FIGS. 5 to 7 on the other hand could be termed a "top push" tap in that, as will be seen and described in detail below, for dispensing pressure is applied downwards.

The tap 52 has many parts in common with tap 2 including an inlet portion 56 and a body portion 58 separated by a liquid inlet 60, the body portion 58 being formed with a spout 64 providing a liquid outlet 62 which in this embodiment is also the air inlet. A button 66 carries a valve stem 72 which in turn carries a valve element 70 having a sealing bead 71. The valve element 70 is frustoconical with a flared mouth such that when tap 52 is closed, sealing bead 71 on the element 70 seats at the annular edge of the spout 64 to seal the outlet 62.

One advantage of the top push tap 52 is that the tap 52 is valved at the liquid outlet, that is, there is no gap between the valve element 70 and the liquid outlet 62 where liquid can be retained when dispensing ceases which would subsequently form drips.

The valve stem 72 is again connected to the button 66 by connection to a boss 78 which protrudes downwardly from the button 66. In this embodiment the valve stem 72 carries fins 82 at its opposite end above the valve element 70.

As the valve element 70 moves within the spout 64, the spout 64 cannot be divided as in the tap 2. However, above the valve element 70, the interior of the body portion 58 is again separated into two regions by a flange element 84. Flange element 84 has a first inner circular portion surrounding a central aperture 86 in which the valve stem 72 moves and a second outer region extending around approximately 270° and having two-downwardly depending fins 88 at its ends. The flange element 84 may be molded as part of the body portion 58 and in addition to dividing that body portion 58 into two regions acts as a solid valve guide. The fins 88 thereof are therefore held static within the body portion 58 and the valve fins 82 are arranged to run adjacent and parallel to the static fins 88.

The static fins 88 define with the walls of the body portion 58 a first air flow passage. The tap 52 includes a second air flow passage in the form of a pipe 90 which extends from flange element 84 transversely to the fins 88 and beyond the inlet portion 56.

Figure 7A:
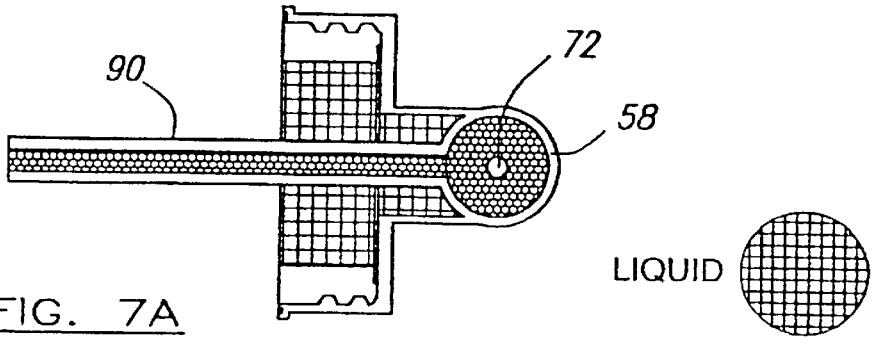
Figure 7B:
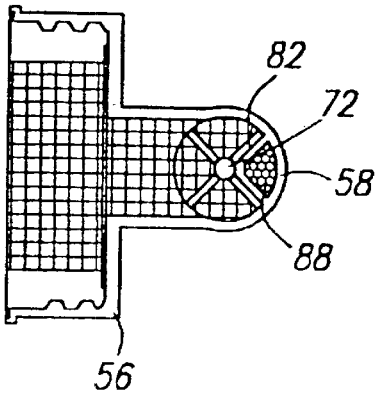

As with the tap 2, on depression of the button 66 the tap 52, the valve element 70 unseats and liquid flows along a liquid flow passageway defined by the first region into which the body portion 58 is divided by flange 84 and out of the spout 64, to one side of the valve element 70. Simultaneously air flows in through the passage defined by static fins 88, into the second region of the body portion 58 and thence through pipe 90 into the container. The air and liquid flows are illustrated clearly in FIGS. 7, 7A and 7B.

The results in terms of maximization of liquid flow rate and smooth flow profile may in some instances be even better with top push tap 52 than with front push tap 2 because the location of the valve element 70 at the outlet permits the relatively elongate protruding pipe 90 which facilitates air return.

While the present invention has been illustrated by a description of a preferred embodiments and while these embodiments have been described in some detail, it is not the intention of the Applicants to restrict or in any way limit the scope of the appended claims to such detail. Additional advantages and modifications will readily appear to those skilled in the art. The various features of the invention may be used alone or in numerous combinations depending on the needs and preferences of the user. This has been a description of the present invention, along with the preferred methods of practicing the present invention as currently known.

However, the invention itself should only be defined by the appended claims, wherein we claim:

1. A tap comprising:

a body having a hollow interior, a liquid inlet, an air inlet, a liquid outlet, an air outlet, and a divider element dividing the hollow interior into a liquid flow passageway between the liquid inlet and the liquid outlet and an air flow passageway between the air inlet and the air outlet, a section of the air flow passageway being separated from the liquid flow passageway, the separated section having an inlet and an outlet, a valve system for controlling liquid and air flow in the flow passageways, and a push button connected to the body for operating the valve system, wherein the air inlet and the liquid outlet are adjacent to each other and the valve system comprises a valve seat, a valve element for engaging the valve seat and a valve stem connecting the valve element to the push button whereby the valve element is movable by pressure on the push button from a first position in which it engages the valve seat and closes the liquid inlet and prevents liquid flow from the tap to a second position in which the valve element is spaced from the valve seat and liquid flows from the tap, wherein the valve element also controls air flow in the air flow passageway and the valve element when in the first position being adjacent to but spaced from the outlet of the separated section of the air passageway, wherein the divider element comprises a flange which divides the hollow interior of the body into two regions and with the body forms the separated section of the air passageway, and wherein the flange includes at least one aperture through which the valve stem passes, the aperture serving to guide the valve stem during movement thereof.

2. A tap as claimed in claim 1, wherein the air inlet and liquid outlet are coincident and the valve seat is adjacent the liquid outlet and the liquid and air flow passageways are upstream of the liquid outlet.

3. A tap as claimed in claim 2, wherein the air flow passageway extends beyond the liquid inlet.

4. A tap as claimed in claim 1, wherein the valve seat is at the liquid inlet and the liquid and air flow passageways are downstream of the liquid inlet.

5. A tap as claimed in claim 1, wherein the tap comprises a flexible member fixed between the valve stem and the body and preventing liquid access to the push button.

6. A tap as claimed in claim 1, wherein the aperture in the flange is banded by a guide sleeve through which the valve stem moves.

7. A tap as claimed in claim 6 further comprising a second guide sleeve spaced from the first guide sleeve.

8. A tap as claimed in claim 7, wherein the second guide sleeve is attached to the valve stem and is connected to the body by a skirt such that the skirt, guide sleeve and stem prevent passage of liquid to the push button.

9. A tap as claimed in claim 1 including a skirt surrounding the valve stem, the skirt having an edge connected to the body such that the skirt and stem together prevent passage of liquid to the push button.

* * * * *